US006718695B1

(12) United States Patent
Park

(10) Patent No.: US 6,718,695 B1
(45) Date of Patent: Apr. 13, 2004

(54) RAILLESS WINDOW AND DOOR SYSTEM

(76) Inventor: Ki-Young Park, 16-3, Gamjung-dong, Kimpo-si, Kyungki-do 415-010 (KR)

( * ) Notice: Subject to any disclaimer, the term of this patent is extended or adjusted under 35 U.S.C. 154(b) by 0 days.

(21) Appl. No.: 10/089,757

(22) PCT Filed: Sep. 30, 2000

(86) PCT No.: PCT/KR00/01093

§ 371 (c)(1),
(2), (4) Date: Apr. 1, 2002

(87) PCT Pub. No.: WO01/25580

PCT Pub. Date: Apr. 12, 2001

(30) Foreign Application Priority Data

Oct. 1, 1999 (KR) ..... 1999-42178
Aug. 24, 2000 (KR) ..... 2000-49094

(51) Int. Cl.[7] ..... E05D 13/00
(52) U.S. Cl. ..... 49/425; 49/410
(58) Field of Search ..... 49/409, 410, 425; 16/87.6 R, 87.8, 91

(56) References Cited

U.S. PATENT DOCUMENTS 4,413,444 A * 11/1983 Chikaraishi ..... 49/409
4,852,628 A * 8/1989 Klein ..... 160/199
5,322,339 A * 6/1994 Dubernard ..... 296/155
5,345,723 A * 9/1994 Gibbs ..... 49/506
5,839,228 A * 11/1998 Duffy ..... 49/223
5,884,361 A * 3/1999 Richardson et al. ..... 16/100

FOREIGN PATENT DOCUMENTS

WO 0413881 * 8/1989 ..... 49/409

* cited by examiner

*Primary Examiner*—Jerry Redman
(74) *Attorney, Agent, or Firm*—Smith-Hill and Bedell, P.C.

(57) ABSTRACT

The present invention relates to an improved lower member of a sliding window and door system, and it is an object of the present invention to provide a convenient, safe and high quality window and door system by solving problems of the conventional window and door system. To provide a flat structure of a railless window and door system of the present invention, a surface member is formed on a window (or door) frame lower member, and to provide a railless structure, a guide device is provided on the window (or door) frame lower member and the window (or door) lower member such that the window (or door) lower member is not inadvertently separated from the window (or door) frame lower member even when the roller is driven on the railless surface member as the window (or door) lower member is guided by the guide device.

25 Claims, 14 Drawing Sheets

RAILLESS WINDOW AND DOOR SYSTEM

FIELD OF THE INVENTION AND PRIOR ART

In the following description, since the door system is identical to the window system, the description of the invention of the window system will be applied to the description of the door system.

In the present invention, a sliding window and door system includes a rectangular window frame having upper, lower, left and right members. The rectangular window frame is mounted on a wall, and a rectangular window having upper, lower, left and right members is mounted on the rectangular window frame, thereby preventing dust, water, noise, and heat from coming into the interior of the room.

A conventional window and door system will be described hereinafter with reference to the drawings.

FIG. 1 shows a front view of a conventional window and door system, and a sectional view taken along line A—A will be illustrated in FIG. 2.

FIG. 2 is a sectional view taken along line A—A of FIG. 1, illustrating a conventional window and door system.

The conventional window and door system comprises a lower member 1 on which exposed rails 11 are formed and lower members 2 which are opened and closed while being guided by the rails 11 and mohairmohair members 22. Rollers 21 are disposed on the rails 11.

PROBLEM TO BE SOLVED BY THE INVENTION

In the above described window and door system, since the door or window is opened and closed along the exposed rails, a water drain portion should be formed on the rails. This limits the improvement of airtightness, watertightness, and thermal insulation, deteriorating the energy efficiency.

In addition, although it is easy to assemble and disassemble the door or window from the frame because of a simple insertion of the door or window into the frame, there may be a possibility that the window and door can be removed from the frame by a strong wind or when it is opened and closed. Accordingly, when it is used for a multistory building, the removal of the window or door can cause an accident.

Since it is not easy to remove dust gathered between the rails and traces of water, the air can be contaminated by the dust when opening and closing the window. When the drain hole formed on the rail is blocked, the water can infiltrate into the interior.

The lower member formed in the prominence and depression manner also deteriorates the aesthetic aspect.

Therefore, the present invention has been made in an effort to solve the above described problems. It is an object of the present invention to provide a window and door system that can improve airtightness, watertightness, thermal isolation, aesthetic aspect and prevent the window (door) from detaching by providing a flattened rail structure.

To achieve the above object, a railless window and door system of the present invention is characterized in that a flat surface member is formed on a window (or door) frame lower member to provide a flat structure, a guide device is provided on the window (or door) frame lower member and window (or door) lower members to provided a railless structure, and since the window (or door) lower members are opened and closed by being guided by the guide devices, the window (or door) lower members are not inadvertently separated from the window frame lower member even when the rollers are operated on the flat surface member.

In addition, a railless window and door system of the present invention is further characterized in that to provide a railless structure, guide devices 131 include guide grooves 132 formed on a window (or door) lower member 130 and guide rollers mounted on lower extension portions extended from lower portions 143 of a window (or door) lower members 140*a* and 140*b*, and since the window (or door) lower members 140*a* and 140*b* are opened and closed while being guided by the guide devices 131, the window (or door) lower members 140*a* and 140*b* are not inadvertently separated from the window (or door) frame lower member 130 even when rollers are driven on the railless surface members.

DESCRIPTION OF THE INVENTION

The embodiments of the present invention will be described hereinafter with reference to the accompany drawings.

In the following description, the terms "upper," "lower," "outside," and "inside" mean "upper side," "lower side," "left side," and "right side," respectively.

First Embodiment

Figure 1:
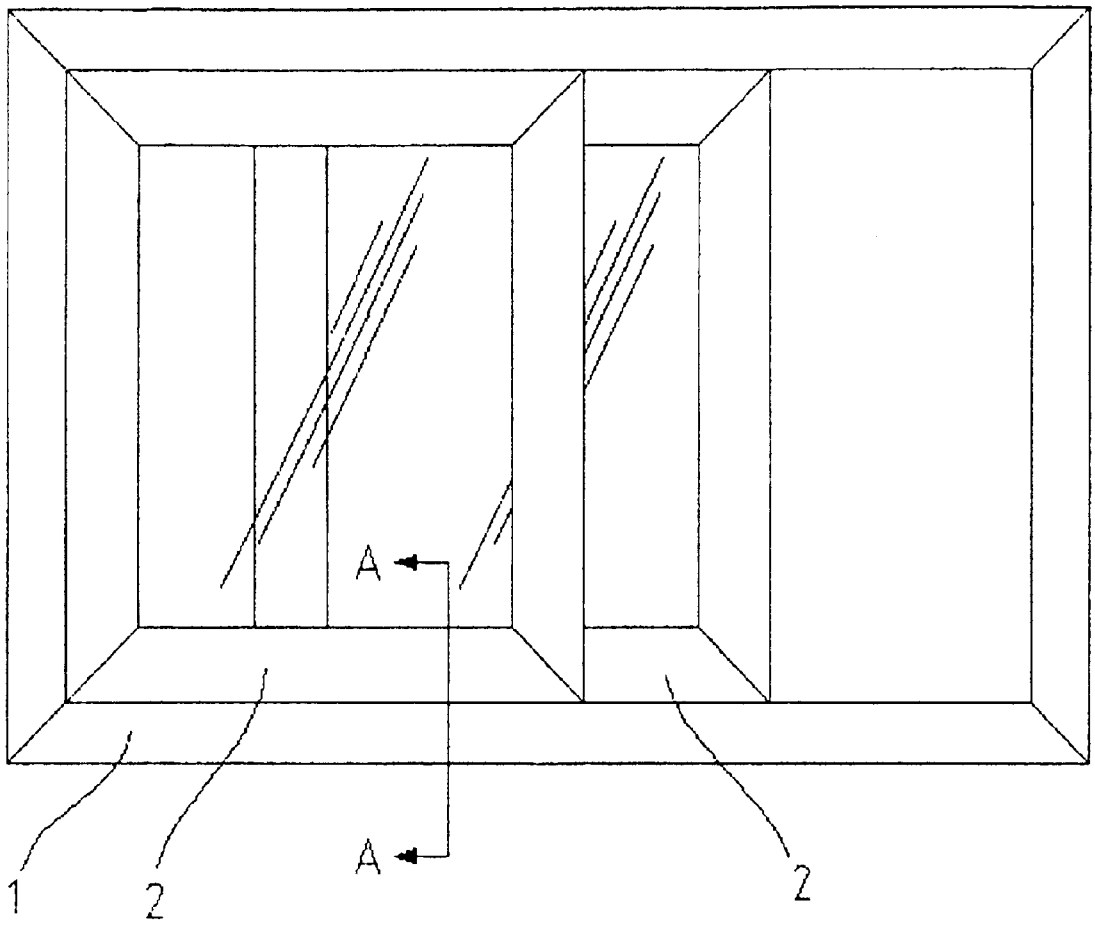
FIG. 1(Prior Art)
FIG. 1 is a schematic view of a conventional window and door system viewed from an outside of a room.
Figure 2:
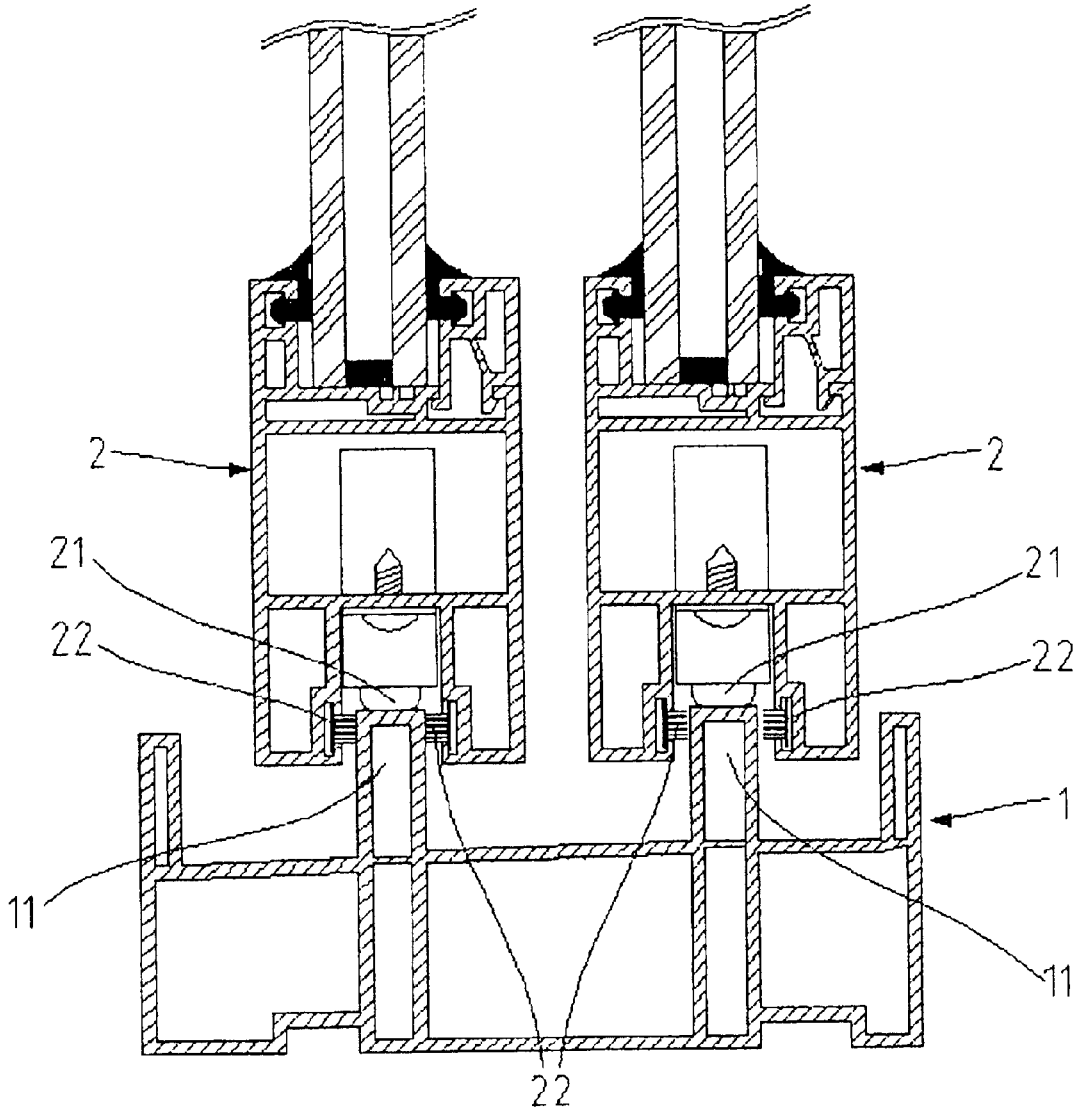
FIG. 2(Prior Art)
FIG. 2 is a sectional view taken along line A—A of FIG. 1.
Figure 3:
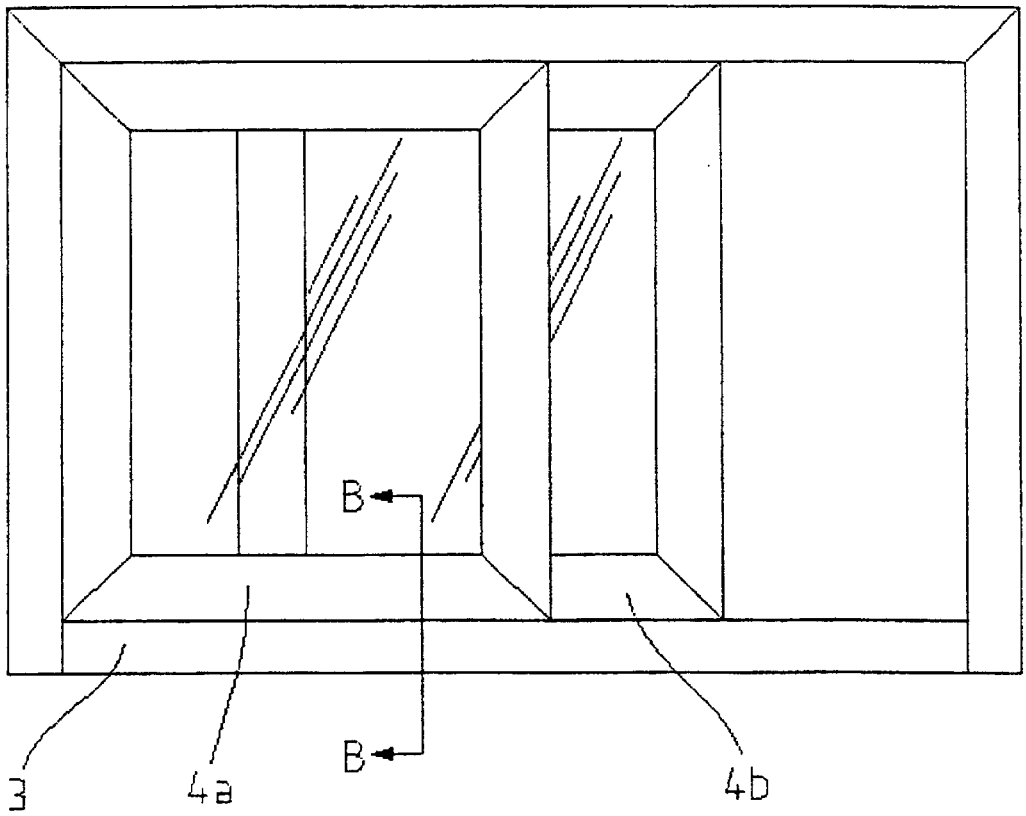
FIG. 3 is a schematic view of a railless window and door system according to the present invention.
Figure 4:
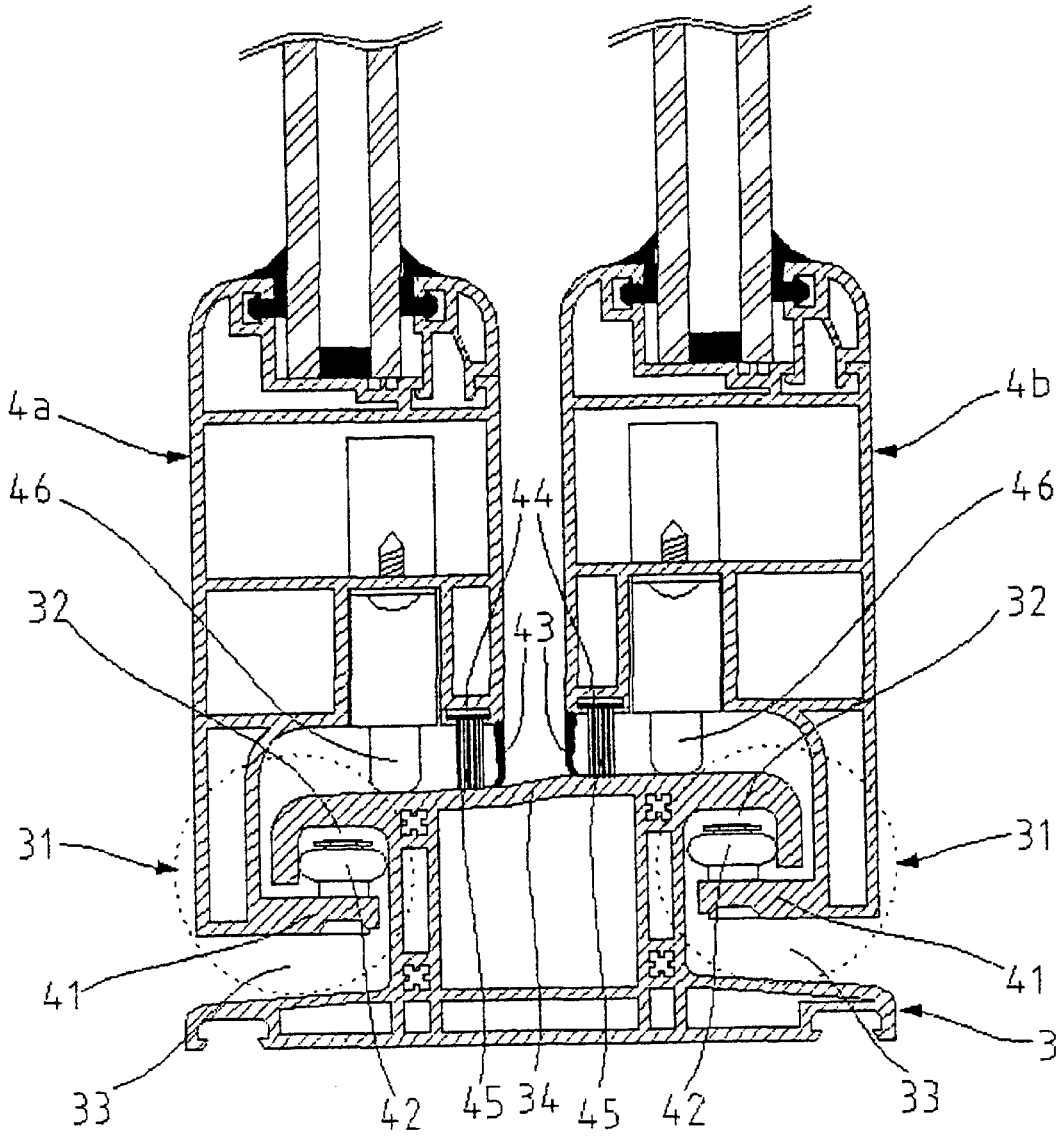
FIG. 4 is a sectional view taken along line B—B of FIG. 3.
Figure 5:
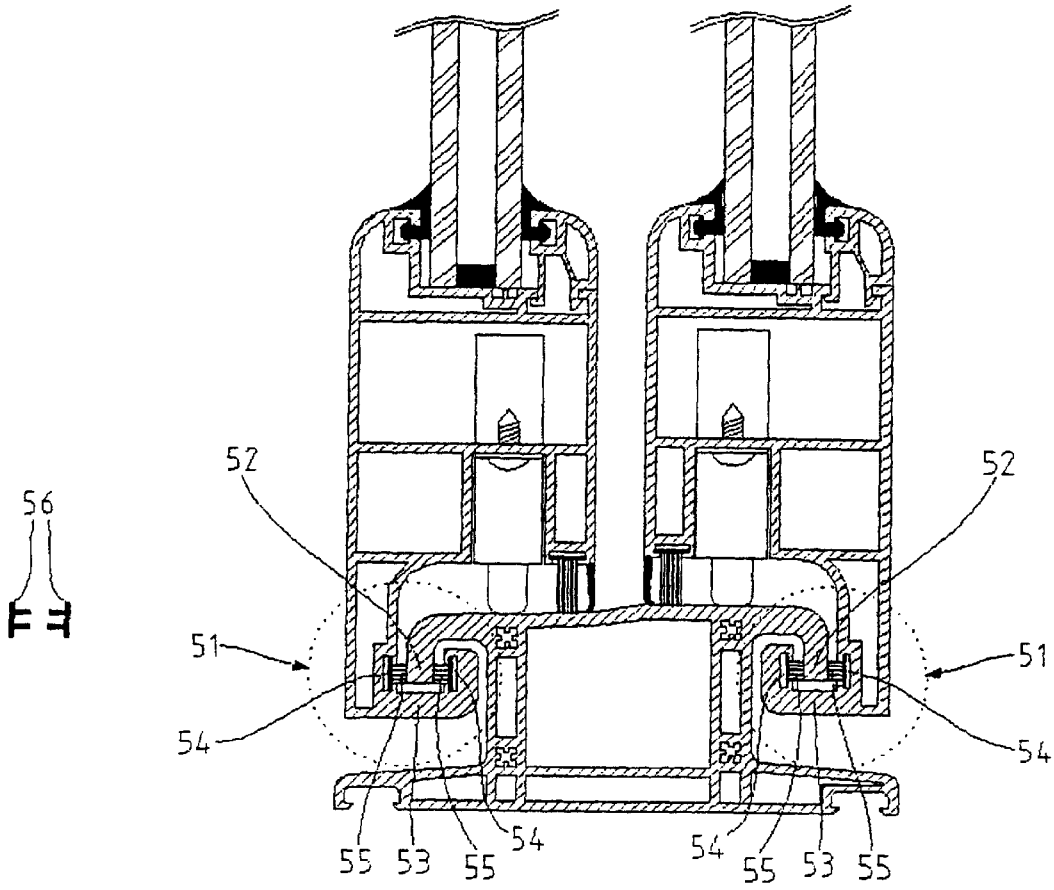
FIG. 5 is a sectional view of a guide system of FIG. 4 according to another embodiment of the present invention.
Figure 6:
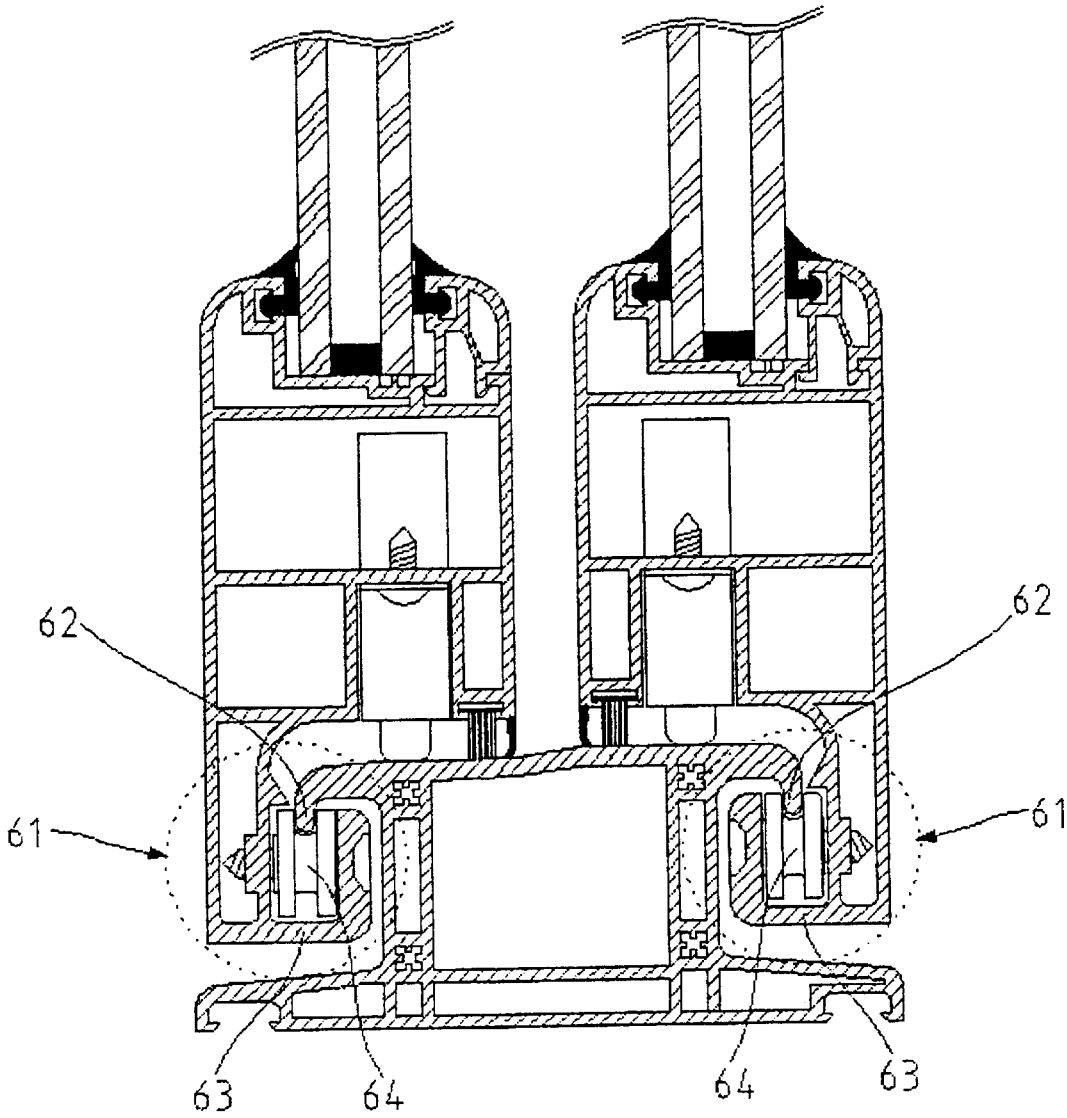
FIG. 6 is a sectional view of a guide system of FIG. 4 according to another embodiment of the present invention.

FIG. 3 shows a railless window and door system view from an outside of a room according to the present invention and the sectional view taken along line B—B is shown in FIGS. 4, 5 and 6.

FIG. 4 shows a sectional view of a railless window and door system taken along line B—B of FIG. 4.

To provide a railless structure, a window frame lower member 3 includes guide devices 31 provided with guide grooves 32 and guide inlets 33 for guiding lower extension portions 41 of window lower members 4*a* and 4*b*, and a railless surface 34 for providing a flat structure.

The window lower members 4*a* and 4*b* include guide rollers 42 mounted on the lower extension portions 41, a gasket 43 for preventing the infiltration of water and air into the room, a mohair member groove 44, mohair members 45 inserted into the mohair member groove 44, and height adjustable rollers 46 mounted to be disassembled.

Since the window lower members 4*a* and 4*b* are opened and closed by the guide devices 31 guiding the guide rollers 42 to be operated in the vicinity of the guide grooves 32 formed in the guide inlets 33, the window is not separated from the window frame lower member 3 even when the rollers 46 are operated on the railless surface 34.

When separating the window, the guide rollers 42 are first separated from the guide grooves 32 by lowering the height adjustable rollers 46, then the window is separated.

FIG. 4 shows a window separable state in a state where the window is assembled.

The railless surface 34 is provided with a molding type slope so that water can be easily expelled out of the system while improving the aesthetic aspect.

FIG. 5 is a view similar to FIG. 4 to illustrate another embodiment of the guide devices.

In the guide devices 51, guide rails 52 are formed on the window frame lower member, and sliding member grooves 54 are formed on lower extension portions 53 extended from a lower portion of the window lower members. The sliding member grooves 54 are formed to correspond with each other on the basis of the guide rails mohair members 55 or sliding members 56 are inserted into the sliding member grooves 54 such that the window can slide by the mohair members 55 or the sliding members 56 mounted on left and right sides of the guide rails.

FIG. 6 is a view similar to FIG. 4 to illustrate another embodiment of the guide devices.

In the guide devices 61, guide rails 62 are formed on window frame lower members, and guide rollers 64 are provided on lower extension portions 63 extended from the lower portion of the window lower members. The guide rollers 64 are mounted in the vicinity of the guide rails 62.

Figure 7:
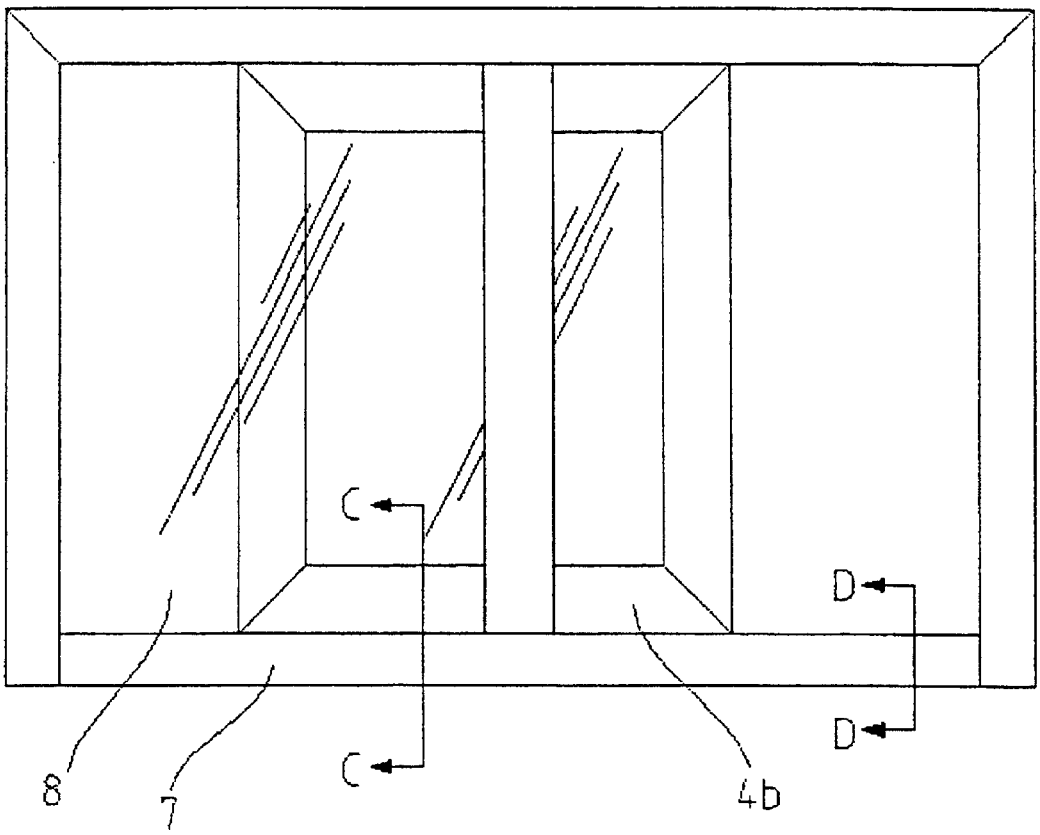
FIG. 7 is a schematic view of a window and door system viewed from an outside of a room, in which an outside window (or door) is replaced with a fixed window (or door) according to the present invention.

FIG. 7 shows a schematic view of a window and door system viewed from an outside of a room, in which an outside window (or door) is replaced with a fixed window (or door) according to the present invention. The sectional views taken along lines C—C and D—D of FIG. 7 are shown in FIGS. 8 and 9, respectively.

Figure 8:
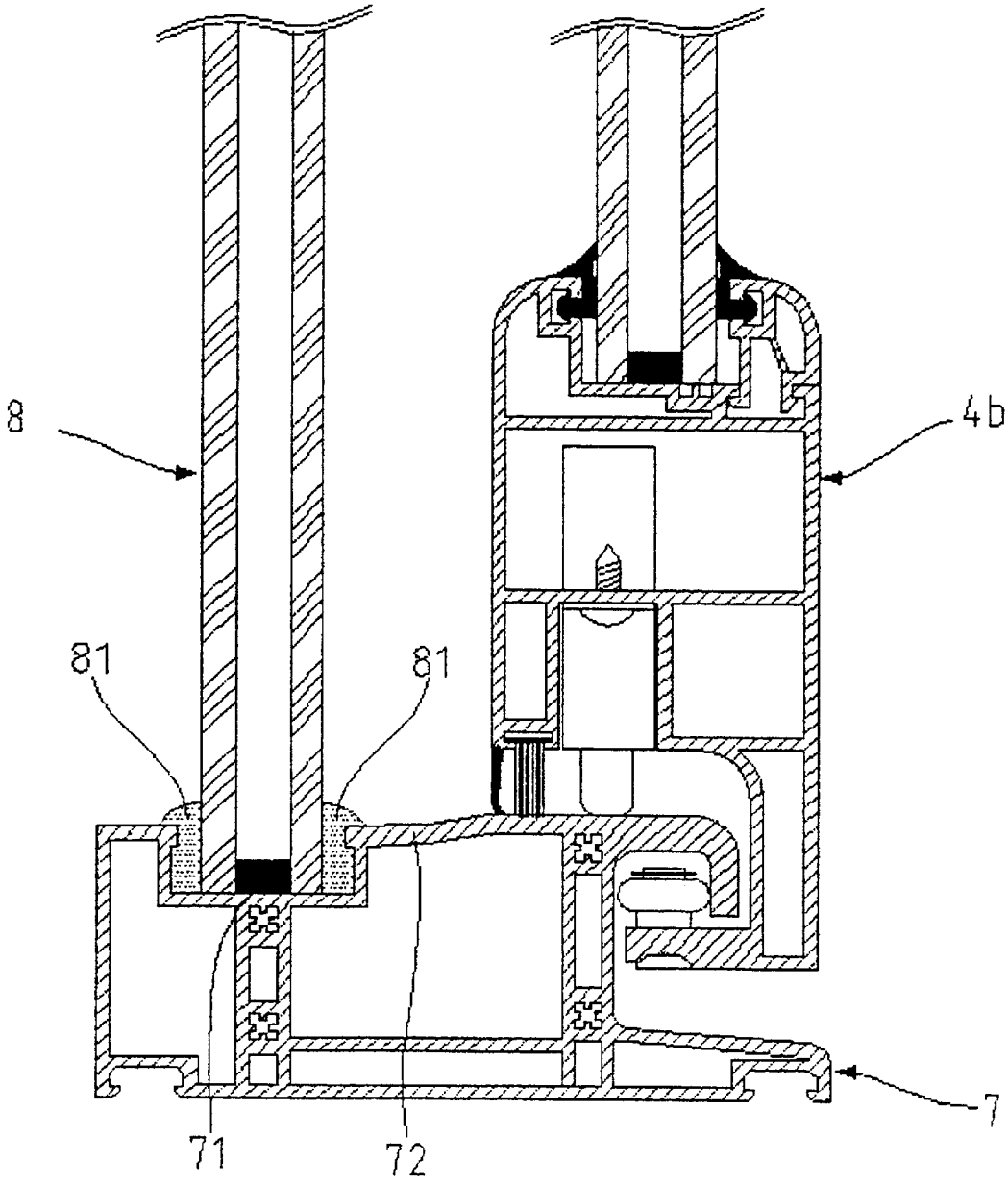
FIG. 8 is a sectional view taken along line C—C of FIG. 7.

FIG. 8 is a sectional view taken along line C—C of FIG. 7, in which the outer window 4*a* depicted in FIG. 4 is replaced with a fixed window 8.

To replace the outer window 4*a* of FIG. 4 with the fixed window 8, a window frame lower member 7 is provided with a fixed window groove 71 on which the fixed window 8 is mounted and a railless surface 72 designed to easily expel water out of the window. After mounting the fixed window 8 on the fixed window groove 71, silicon members 81 are used as a final material.

Figure 9:
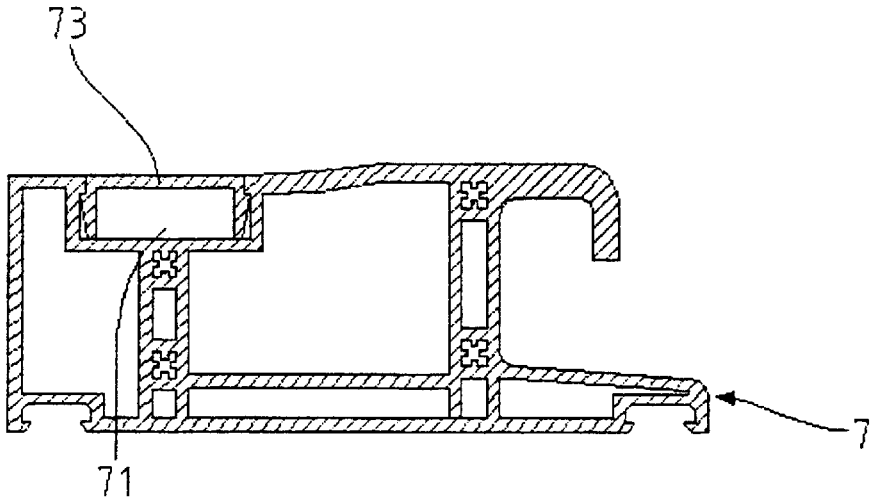
FIG. 9 is a sectional view taken along line D—D of FIG. 8.

FIG. 9 shows a sectional view taken along line D—D of FIG. 7, in which a fixed window groove cover 73 is mounted on a section where the fixed window 8 is not mounted.

Figure 10:
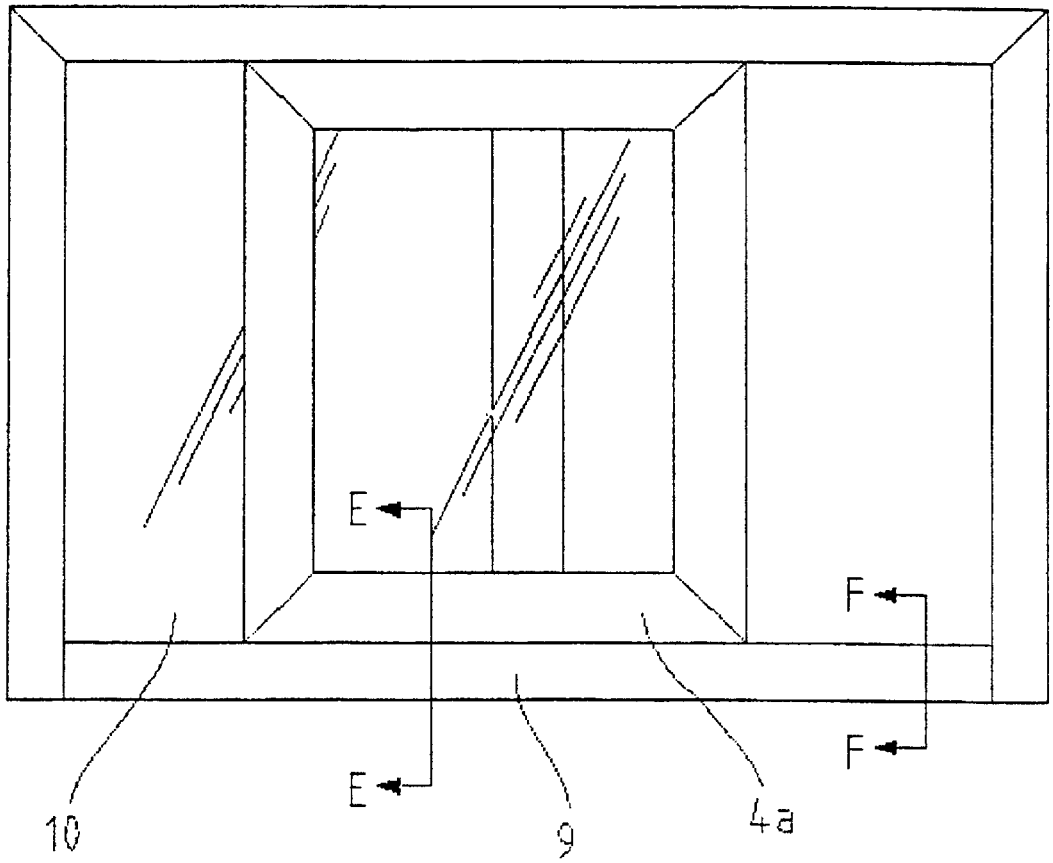
FIG. 10 is a schematic view of a window and door system viewed from an outside of a room, in which an inside window (or door) is replaced with a fixed window (or door) according to the present invention.

FIG. 10 shows a schematic view of a window and door system viewed from an outside of a room, in which an inner window (or door) is replaced with a fixed window (or door) according to the present invention. Sectional views taken along lines E—E and F—F of FIG. 10 are shown in FIGS. 11 and 12, respectively.

Figure 11:
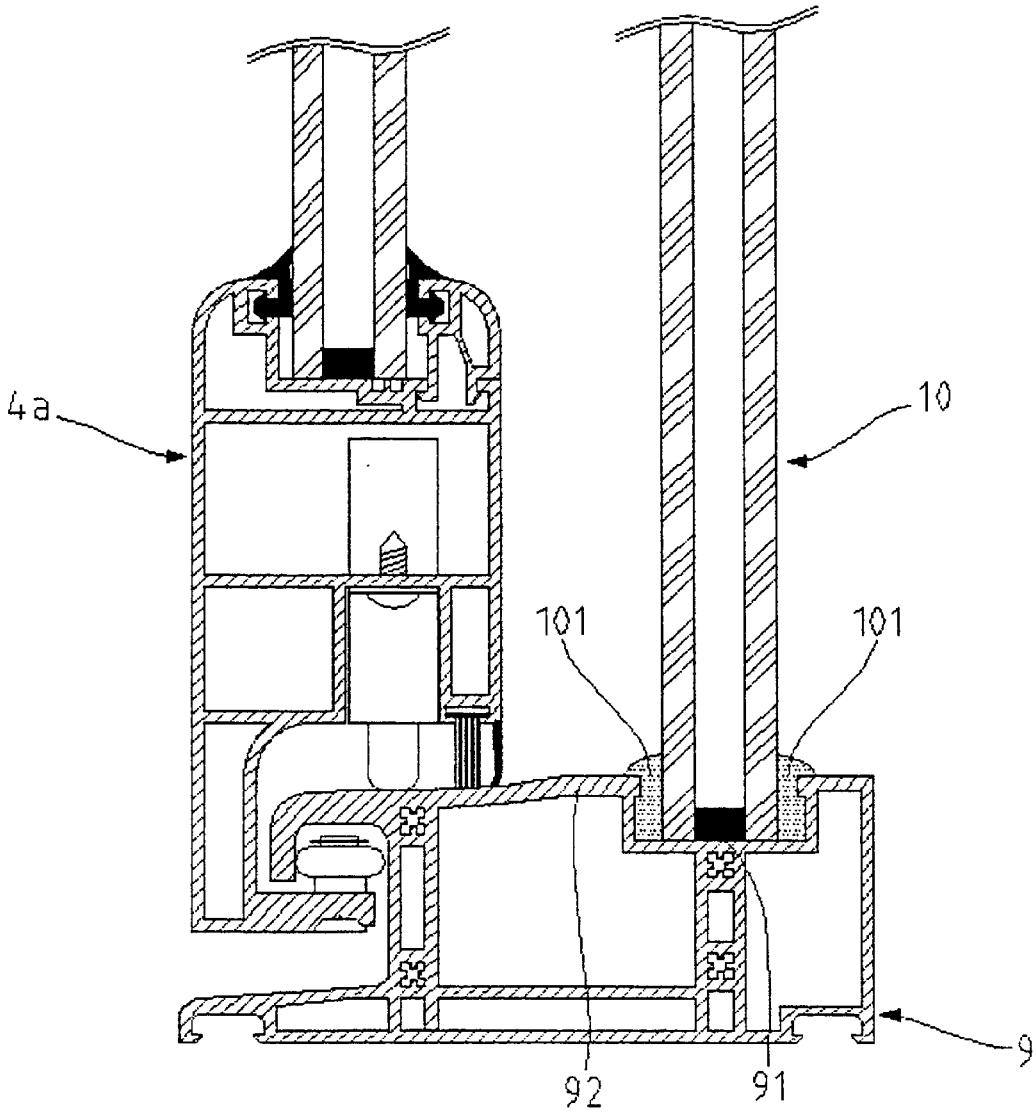
FIG. 11 is sectional view taken along line E—E of FIG. 10.

FIG. 11 shows a sectional view taken along line E—E of FIG. 10, in which the inner window 4*b* depicted in FIG. 4 is replaced with a fixed window.

To replace the inner window 4*b* with the fixed window 10, the window lower member 9 is provided with a fixed window groove 91 for mounting the fixed window 10*a* and a railless surface 92 formed to easily expel water. The fixed window 10 is mounted on the fixed window groove 91 and finalized by silicon members 101.

Figure 12:
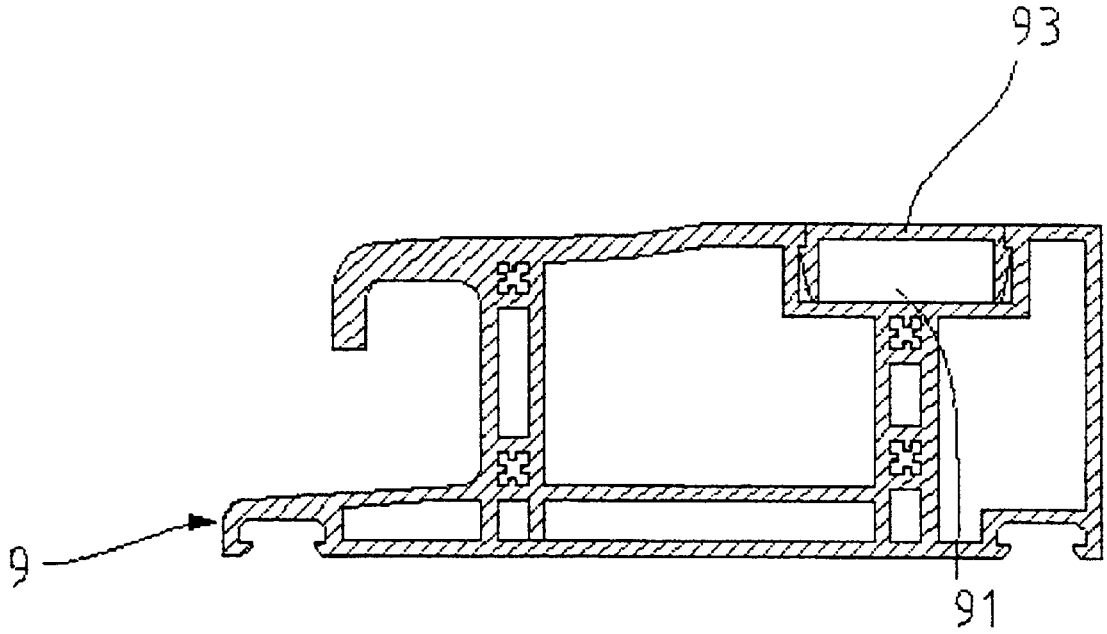
FIG. 12 is a sectional view taken along line F—F of FIG. 10.

FIG. 12 shows a sectional view taken along line F—F of FIG. 10, in which a fixed window groove cover 93 is mounted on a section where the fixed window 10 is not mounted.

Second Embodiment

Figure 13:
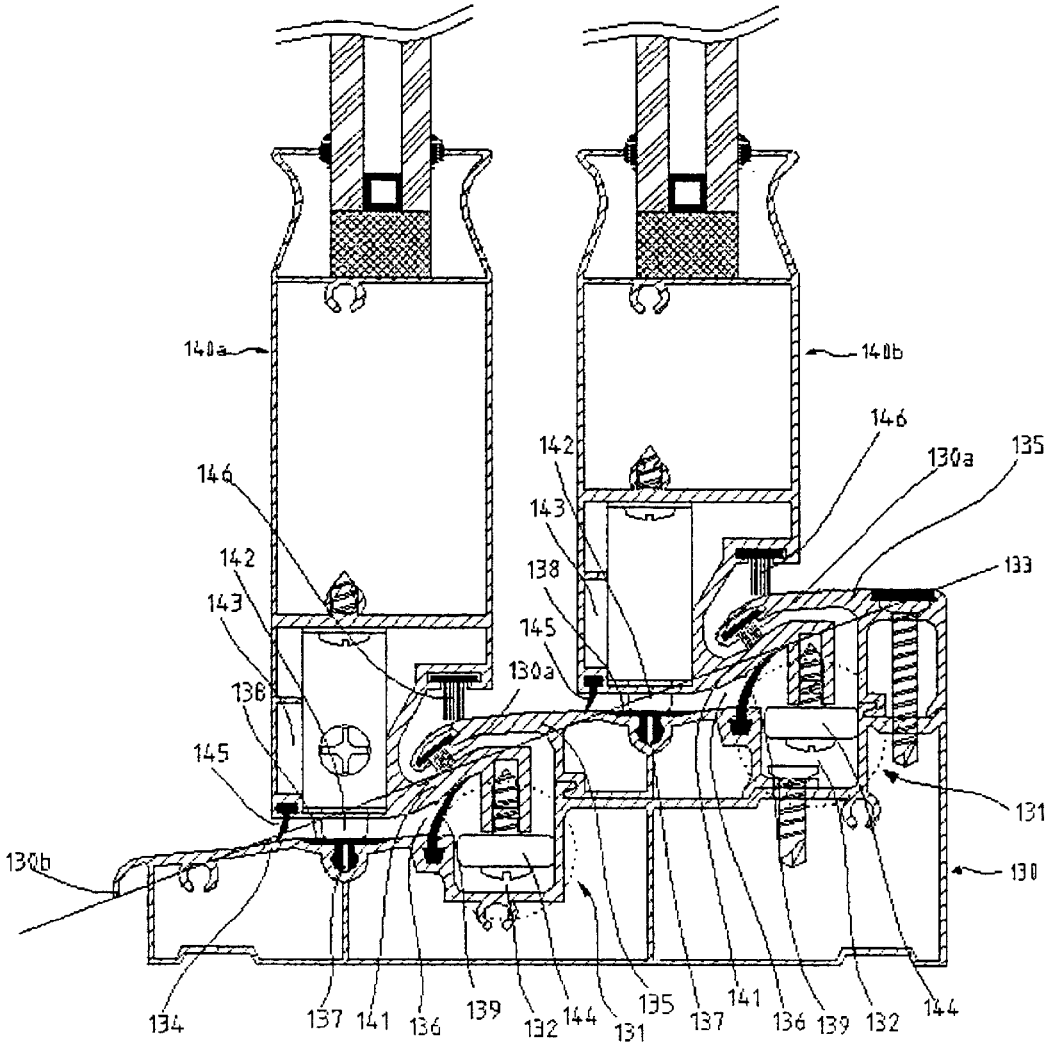
FIG. 13 is a sectional view taken along line B—B of FIG. 3 according to another embodiment of the present invention.

FIG. 13 shows a sectional view of a railless window and door system taken along line B—B of FIG. 4 according to another embodiment of the present invention.

To provide a railless structure, a window frame lower member 130 includes guide devices 131 provided with guide grooves 132 and a railless surface 134 on which a molding type slope having an outward trajectory 133 is used as a water outlet. Guide groove covers 135 are formed covering the guide grooves 132. The guide devices 131 are further provided with guide inlets 136 for guiding lower extension portions 141 of the window. Roller support grooves 137 are provided to mount roller support members 138 that can prevent the surface 134 or the cover 135 from being damaged by rollers 142 when the windows 140*a* and 140*b* are opened and closed. Gaskets 139 are provided to prevent water from infiltrating into the guide grooves 132, and mohair members 130*a* are provided to prevent interior air from going out of the room. A lower rail 130*b* is formed to mount a mothproof window.

Window lower members 140*a* and 140*b* include guide rollers 42 mounted on the lower extension portions 141. Height adjustable rollers 142 for adjusting opening/closing height of the window are formed on the lower portions of the window lower members 140*a* and 140*b*. Gaskets 145 and mohair members 146 are provided to prevent the flow of air and water.

Since the windows are opened and closed by the guide devices 131 guiding the guide rollers 142 to be operated in the vicinity of the guide grooves 132, the window is not inadvertently separated from the window frame lower member 131 even when the rollers 142 are operated on the railless surface 134 or cover 135.

Figure 14:
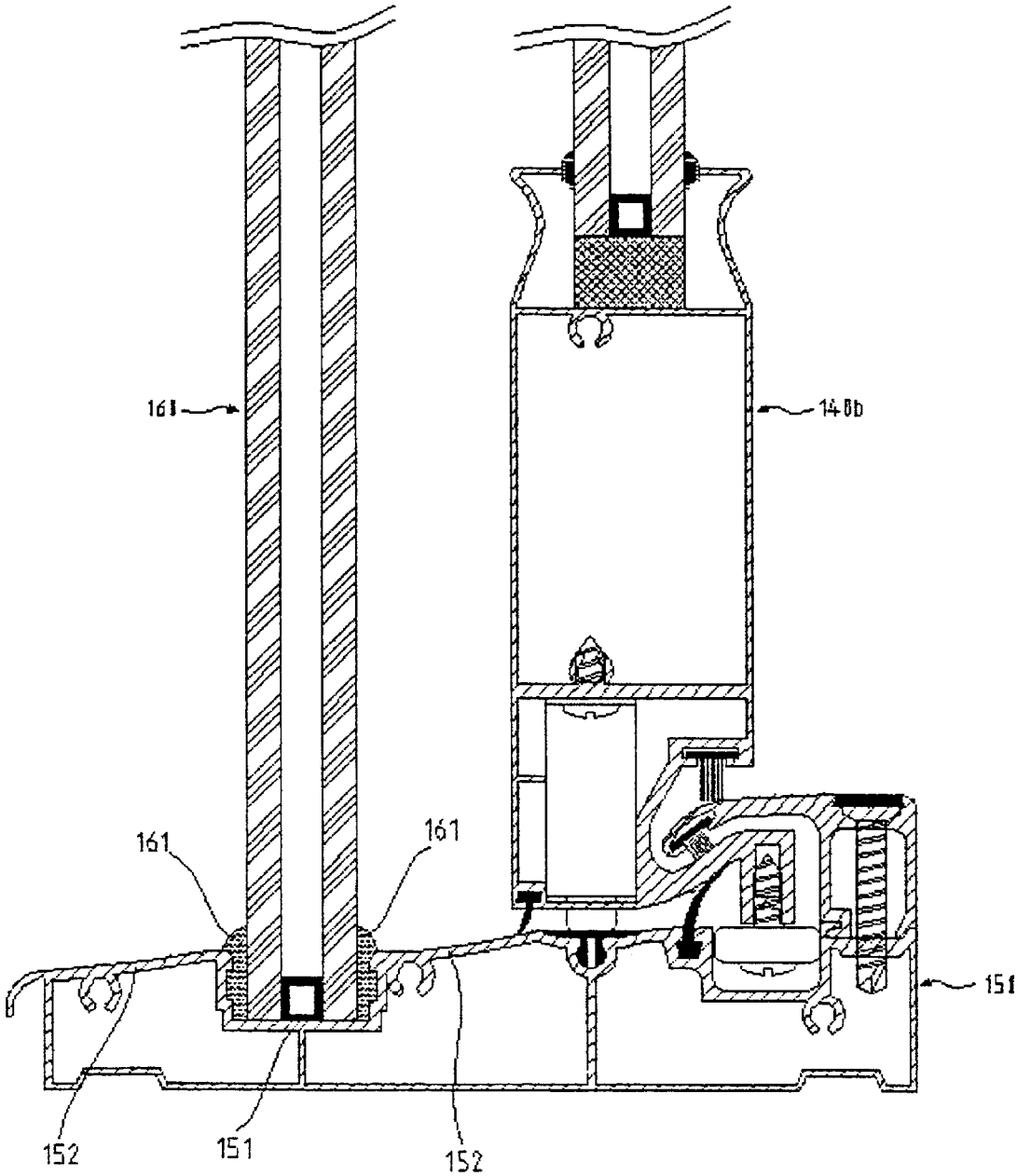
FIG. 14 is a sectional view taken along line C—C of FIG. 5 according to another embodiment of the present invention.

FIG. 14 shows a sectional view taken along line C—C of FIG. 14, in which the outer window 140*a* depicted in FIG. 13 is replaced with a fixed window 160 according to another embodiment of the present invention.

To replace the outer window 140*a* with a fixed window 160, the window frame lower member 150 is provided with a fixed window groove 151 to mount the fixed window and railless surfaces 152 for easily expelling water out of the surface 152. The fixed window 160 is mounted on the fixed window groove 151 and finalized by silicon members 161.

Figure 15:
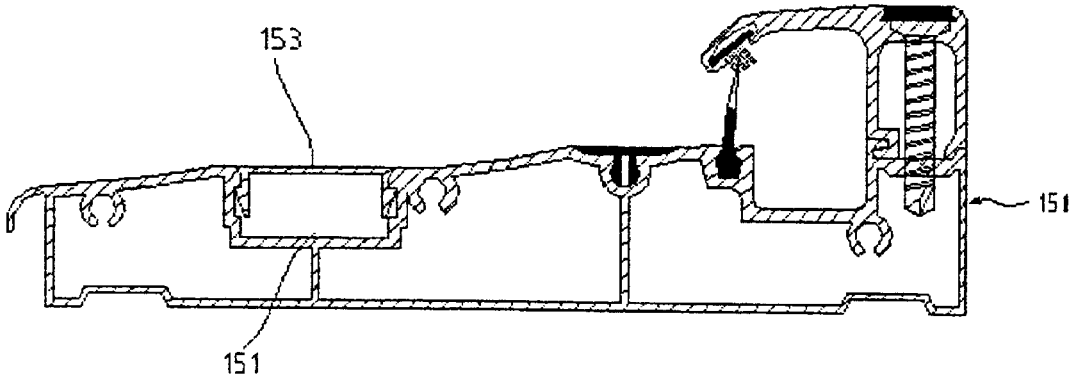
FIG. 15 is a sectional view taken along line D—D according to another embodiment of the present invention.

FIG. 15 shows a sectional view taken along line D—D of FIG. 5, in which a section of a fixed window groove 151 on which the fixed window 160 is not mounted is covered by a fixed window groove cover 153.

EFFECT OF THE INVENTION

As described above, since the window frame lower members 4*a* and 4*b* are opened and closed while being guided by the guide devices 31, the rollers 46 can be operated on a railless flat surface 34.

Accordingly, since the water drain hole which has been required in the conventional rail structure is not necessary, improvements in the airtightness and water tightness occur. It is easy to remove collected dust, making the surface clean. Furthermore, the sloped surface smoothly expels water out of the frame, thus damage caused by the water can be prevented.

In addition, since the window is not inadvertently removed from the frame, safety can be improved.

Since a gap between the window frame lower member and the window lower member is sealed by the gasket and mohair members, the airtightness, watertightness, and thermal insulation can be greatly improved.

Since the surface is formed with a smooth molding type, the aesthetic aspect can be improved, thereby providing a high quality window and door system.

What is claimed is:

1. A door or window system comprising:

a frame including a frame lower member having a top surface, said top surface including a flat portion extending lengthwise of the frame lower member, a slidable panel mounted in the frame and including a panel lower member having first and second opposite faces, one of said first and second opposite faces being an inner face of the panel lower member and the other of said first and second opposite faces being an outer face of the panel lower member, a roller mounted on the panel lower member and engaging the flat portion of the top surface of the frame lower member, for supporting the panel lower member during sliding movement of the slidable panel, and a guide device comprising a first part provided on the frame lower member and a second part provided on the panel lower member, the guide device guiding sliding movement of the slidable panel along the frame lower member, and wherein the top surface of the frame lower member includes a portion that extends laterally beyond said first face of the panel lower member.

2. A door or window system according to claim 1, wherein the first part of the guide device includes a flange extending downwards from the top surface of the frame lower member, whereby the frame lower member defines a guide groove that extends lengthwise of the frame lower member and is open from below, and the second part of the guide device includes a guide member that is attached to the panel lower member and is received in the guide groove.

3. A door or window system according to claim 1, wherein the first part of the guide device includes a flange extending downwards from the top surface of the frame lower member, whereby the frame lower member defines a guide groove that extends lengthwise of the frame lower member, and the second part of the guide device includes a guide roller that is attached to the panel lower member and is received in the guide groove.

4. A door or window system according to claim 1, wherein the first part of the guide device includes a guide rail extending downwards from the top surface of the frame lower member, the second part of the guide device includes a lower extension portion extending from the panel lower member and including first and second portions defining a channel that extends lengthwise of the panel lower member and into which the guide rail extends.

5. A door or window system according to claim 4, wherein the first and second portions of the lower extension portion of the panel lower member are provided with grooves in confronting relationship with opposite respective sides of the rail, and the system further comprises sliding members that are received in the grooves respectively and engage the guide rail.

6. A door or window system according to claim 1, wherein the first part of the guide device includes a guide rail extending downwards from the top surface of the frame lower member, and the second part of the guide device includes a lower extension portion extending from the panel lower member and a guide roller that is attached to the lower extension portion of the panel lower member and is engaged by the guide rail.

7. A door or window system according to claim 6, wherein the guide roller has a peripheral groove and the guide rail engages the peripheral groove of the guide roller.

8. A door or window system according to claim 1, wherein the flat portion of the top surface of the frame lower member is a first portion of the top surface of the frame lower member, the top surface of the frame lower member has a second portion, alongside said first portion, said second portion of the top surface of the frame lower member is formed with a groove, and the system further comprises a fixed panel mounted in a first length portion of the groove and a groove cover mounted in a second length portion of the groove.

9. A door or window system according to claim 1, wherein the roller is removable from the panel lower member and is adjustable for adjusting the height of the panel lower member relative to the frame lower member.

10. A door or window system according to claim 1, wherein the portion of the top surface of the frame lower member that extends laterally beyond the first face of the panel lower member is sloped for directing water to flow away from the flat portion, and the system further comprises a means attached to the panel lower member at the first face thereof for resisting passage of air or water between the panel lower member and the frame lower member.

11. A door or window system according to claim 1, wherein the flat portion of the top surface of the frame lower member is a first portion of the top surface of the frame lower member, the top surface of the frame lower member has a second flat portion, alongside said first portion, and the system further comprises a second slidable panel mounted in the frame and a second roller mounted on the second slidable panel and engaging the second flat portion of the top surface of the frame lower member, for supporting the second slidable panel during sliding movement thereof.

12. A door or window system according to claim 1, wherein the first part of the guide device comprises a means defining a guide groove and the second part of the guide device comprises a guide roller mounted on a lower extension of the panel lower member.

13. A door or window system according to claim 1, wherein the first part of the guide device includes a flange portion that defines a channel that extends lengthwise of the frame lower member and is open downwards, and the second part of the guide device extends into said channel from below for guiding sliding movement of the slidable panel along the frame lower member.

14. A door or window system comprising:

a frame including an elongate frame lower member having an upper surface, the frame lower member including a flange portion that defines a channel that extends lengthwise of the frame lower member and is open downwards, a slidable panel mounted in the frame and including a panel lower member and a guide portion that extends into said channel from below for guiding sliding movement of the slidable panel along the frame lower member, said guide portion of the slidable panel including a guide roller that is attached to the panel lower member and is received in the channel, and a support roller mounted on the panel lower member and engaging the upper surface of the frame lower member, for supporting the panel lower member during sliding movement of the slidable panel.

15. A door or window system according to claim 14, wherein the guide portion of the slidable panel includes a lower extension portion extending from the panel lower member and the guide roller is attached to the lower extension portion of the panel lower member and is engaged by the flange portion of the frame lower member.

16. A door or window system according to claim 15, wherein the guide roller has a peripheral groove and the flange portion engages the peripheral groove of the guide roller.

17. A door or window system according to claim 14, wherein the upper surface of the frame lower member has a first portion that is engaged by the support roller mounted on the panel lower member and also has a second portion, alongside said first portion, said second portion of the upper surface of the frame lower member is formed with a groove, and the system further comprises a fixed panel mounted in a first length portion of the groove and a groove cover mounted in a second length portion of the groove.

18. A door or window system according to claim 14, wherein the support roller is removable from the panel lower member and is adjustable for adjusting the height of the panel lower member relative to the frame lower member.

19. A door or window system according to claim 14, wherein the upper surface of the frame lower member has a first portion that is engaged by the support roller mounted on the panel lower member and has a second portion that is sloped for directing water to flow away from the first portion, and the system further comprises a means attached to the panel lower member for resisting passage of air or water between the panel lower member and the frame lower member.

20. A door or window system according to claim 14, wherein the upper surface of the frame lower member has a first portion that is engaged by the support roller mounted on the panel lower member and has a second portion alongside said first portion, and the system further comprises a second slidable panel mounted in the frame and a second support roller mounted on the second slidable panel and engaging the second portion of the upper surface of the frame lower member, for supporting the second slidable panel during sliding movement thereof.

21. A door or window system comprising:

a frame including an elongate frame lower member having an upper surface, the frame lower member including a portion that defines a channel that extends lengthwise of the frame lower member and is closed from above, a slidable panel mounted in the frame and including a panel lower member and a guide portion that extends into said channel for guiding sliding movement of the slidable panel along the frame lower member, and a roller mounted on the panel lower member and engaging the upper surface of the frame lower member, for supporting the panel lower member during sliding movement of the slidable panel, and wherein the upper surface of the frame lower member has a first portion that is engaged by the roller mounted on the panel lower member and also has a second portion, alongside said first portion, said second portion of the upper surface of the frame lower member is formed with a groove, and the system further comprises a fixed panel mounted in a first length portion of the groove and a groove cover mounted in a second length portion of the groove.

22. A door or window system according to claim 21, wherein the frame lower member includes a guide rail extending downwards relative to the upper surface of the frame lower member, and the guide portion of the slidable panel includes an extension portion extending from the panel lower member and including first and second portions defining a channel that extends lengthwise of the panel lower member and into which the guide rail extends.

23. A door or window system according to claim 21, wherein the roller is removable from the panel lower member and is adjustable for adjusting the height of the panel lower member relative to the frame lower member.

24. A door or window system according to claim 21, wherein the upper surface of the frame lower member has a first portion that is engaged by the roller mounted on the panel lower member and has a second portion that is sloped for directing water to flow away from the first portion, and the system further comprises a means attached to the panel lower member for resisting passage of air or water between the panel lower member and the frame lower member.

25. A door or window system according to claim 21, wherein the upper surface of the frame lower member has a first portion that is engaged by the roller mounted on the panel lower member and has a second portion alongside said first portion, and the system further comprises a second slidable panel mounted in the frame and a second roller mounted on the second slidable panel and engaging the second portion of the upper surface of the frame lower member, for supporting the second slidable panel during sliding movement thereof.

* * * * *